US007080765B2

(12) United States Patent
Miller

(10) Patent No.: US 7,080,765 B2
(45) Date of Patent: Jul. 25, 2006

(54) MULTIPLE ROLL AND BOXED GOODS DISPENSER

(76) Inventor: Joseph W Miller, 16 Timberleigh Ct., Manchester, MO (US) 63021

( * ) Notice: Subject to any disclaimer, the term of this patent is extended or adjusted under 35 U.S.C. 154(b) by 0 days.

(21) Appl. No.: 10/270,898

(22) Filed: Oct. 15, 2002

(65) Prior Publication Data

US 2003/0071100 A1 Apr. 17, 2003

Related U.S. Application Data

(60) Provisional application No. 60/329,272, filed on Oct. 15, 2001.

(51) Int. Cl.
*B26F 3/02* (2006.01)

(52) U.S. Cl. ..... 225/38; 225/42; 242/598.3; 211/71.01

(58) Field of Classification Search ..... 225/38, 225/42, 77, 90, 37, 34, 81, 55.3, 55.53; 242/55.3, 242/55.53
See application file for complete search history.

(56) References Cited

U.S. PATENT DOCUMENTS

| | | | | | |
|---|---|---|---|---|---|
| 392,502 | A | * | 11/1888 | Earl | 225/38 |
| 838,517 | A | * | 12/1906 | Bowser | 242/594.5 |
| 972,160 | A | * | 10/1910 | Canham | 242/129.71 |
| 1,565,035 | A | * | 12/1925 | Kenzo | 225/88 |
| 2,056,572 | A | * | 10/1936 | Gibbs | 225/38 |
| 2,948,451 | A | * | 8/1960 | Swanson | 225/38 |
| 2,969,169 | A | * | 1/1961 | Botnick | 225/43 |
| 3,156,392 | A | * | 11/1964 | Johannes | 225/38 |
| 3,603,519 | A | * | 9/1971 | Brown et al. | 242/594.1 |
| 3,693,853 | A | * | 9/1972 | Siegal | 225/58 |
| 3,799,466 | A | * | 3/1974 | Adams | 242/596.3 |
| 4,027,795 | A | * | 6/1977 | Rigden | 206/409 |
| 4,520,968 | A | * | 6/1985 | Shpigelman | 242/560.3 |
| 4,525,235 | A | * | 6/1985 | Todisco | 156/511 |
| 4,645,107 | A | * | 2/1987 | Norris | 225/37 |
| 4,762,042 | A | * | 8/1988 | Denter et al. | 83/374 |
| 4,807,764 | A | * | 2/1989 | Bellin | 211/94.01 |
| 5,143,230 | A | * | 9/1992 | LaCorte | 211/85.28 |
| 5,307,969 | A | * | 5/1994 | Menendez | 225/42 |
| 5,363,997 | A | * | 11/1994 | Harris | 225/25 |
| 5,495,653 | A | * | 3/1996 | Schrock et al. | 29/401.1 |
| 5,556,019 | A | * | 9/1996 | Morris | 225/96 |
| 5,651,487 | A | * | 7/1997 | Hansen | 225/106 |

(Continued)

*Primary Examiner*—Allan N. Shoap
*Assistant Examiner*—Ghassem Alie

(57) ABSTRACT

A dispenser for locating beneath a wall cabinet or shelf and provided for dispensing sheet materials, or boxed material, such as sheets, or bags. The dispenser includes a pair of support beams, one normally for locating the front, and the other at the back, and a pivotal door connecting to the front beam. The space between the beams are compartmentalized, and end walls provide closure to the dispenser. The various compartments are provided for mounting miscellaneous rolls or boxes of dispensed material. One or more styles of clamps connect to one or both of the beams, and can hold, for example, a roll of paper towels, while other compartments include lower flanges, for support of the rolls or boxed material, for dispensing. Various types of roll holding devices, such as shaped wire, are resilient and flexible members are designed for holding rolls of the sheet materials in place, during dispensing. The dispenser may be reversed, to locate the rolled dispensing material, such as towels, at either end of the dispenser. A shaped wire, or thin flexible member, may extend from one beam of the dispenser, for engagement within the bottom of a box, for holding the box of material during dispensing, or the device may be used in a drawer, to hold boxed goods therein for dispensing.

3 Claims, 10 Drawing Sheets

U.S. PATENT DOCUMENTS 5,688,098 A * 11/1997 Theno ..... 414/277
5,765,719 A * 6/1998 Upham et al. ..... 221/196
5,975,329 A * 11/1999 Schmitt ..... 220/350
6,685,075 B1 * 2/2004 Kannankeril ..... 225/96

* cited by examiner

MULTIPLE ROLL AND BOXED GOODS DISPENSER

This application claims the benefit of Provisional Application No. 60/392,272, filed Oct. 15, 2001.

BACKGROUND OF THE INVENTION

The present invention relates to new and useful improvements in dispensers for household roll products such as plastic wrap, foil, wax paper, paper towels, and boxed goods such as sandwich bags, freezer bags, and trash bags, etc.

In the U.S. Pat. No. 5,129,565 issued Jul. 14, 1992, to Joseph W. Miller, the inventor in this application, there is disclosed a dispenser cabinet for organizing and dispensing one or more sheet materials, such as described above. Dispensing compartments are formed by horizontally spaced vertical panels attached to a pair of support beams. A roll compartment comprises a cantilevered shelf which supports the roll, a dispensing slit formed by the space between the edge of the cantilevered shelf an its adjacent vertical panel, and a cutting edge located on the bottom of said panel. A box compartment is defined by the space between any two said panels and a cantilevered shelf does not require a cutting edge. A paper towel holding means is attached to the end of the support beams and above the plane of the smaller rolls and their respective compartments. A door attaches to one of the said beams enclosing the dispensing compartments when said dispenser is attached to an existing wall cabinet.

The manufacture of the prior dispensing cabinet is relatively expensive and uneconomical to manufacture with the visible paper towel holding means as disclosed. The said dispenser has a design feature that requires right or left hand tearing when employed in one of its more useful embodiments. The present invention requires the manufacture of both left and right tear models as the invention as disclosed does not permit reversibility, that is, the manufacture of a single model that could be used either as a right or left tear as determined by the consumer. Furthermore, while the consumer has no objection to paper towel holders that visibly expose the paper towels, when given the choice to conceal the paper towel behind a door like the other wrap products, the consumer prefers the concealed look. The prior dispenser did not address this consumer preference and the resulting effects on the dispenser.

Another disadvantage of said dispenser is the cantilevered bottom shelf. This is an extra element that adds weight and costs to the overall invention that may not be required. Furthermore, the attachment of the bottom panel by the cantilevered design requires additional strength for the vertical side panels. Thus, by the elimination of the bottom panels further reduction of material and weight can be eliminated from the side panels.

Another disadvantage of the bottom panels as used in the invention to support rolls, occurs with the reduction of weight as the sheet materials are spent. The frictional forces that are employed by the rolls are dependent on weight and that decreases as the roll is spent. The tearing and dispensing of the roll is dependent on these frictional forces and becomes more difficult as the roll is more than fifty percent spent.

The increased use of boxed goods also provides consumers with more choices and more storage and dispensing requirements for these goods. The unmovable and fixed box holding means limits the number of models that can be offered economically and impacts negatively on the commercial success of the invention. Thus, the present invention is concerned with one or more improvements in such a dispenser.

SUMMARY OF THE INVENTION

Accordingly, besides the advantages of the existing prior art, several objects and advantages of the present invention are:

to provide a multi roll household goods cabinet dispenser that provides for concealing the paper towel behind the dispensed door;

to provide a dispenser with a removable reversible paper towel holding means that provides adjustable tension control;

to provide a dispenser with a removable reversible roll holding means that provides adjustable tension control and eliminates the need for a roll support shelf;

to provide a one piece molded dispenser with a fixed roll holding means that provides for reversibility, tension control, and a manual stop or breaking feature;

to provide a dispenser with a removable reversible box holding means that eliminates the need for a box compartment and box shelf; and to provide a dispenser that can provide a plurality of roll-box configurations.

Further objects and advantages are to provide a new method of dispensing boxed goods such as sandwich bags, freezer bags, trash bags, etc., such that they may be dispensed directly from an existing object such as a kitchen drawer, cabinet door, whereby the box is held by relatively thin and flexible holding means between the means and the folds of the box. Additional boxed wrap dispensers may be possible due to invention of this box holding means.

DESCRIPTION OF THE PREFERRED EMBODIMENT

Figure 1:
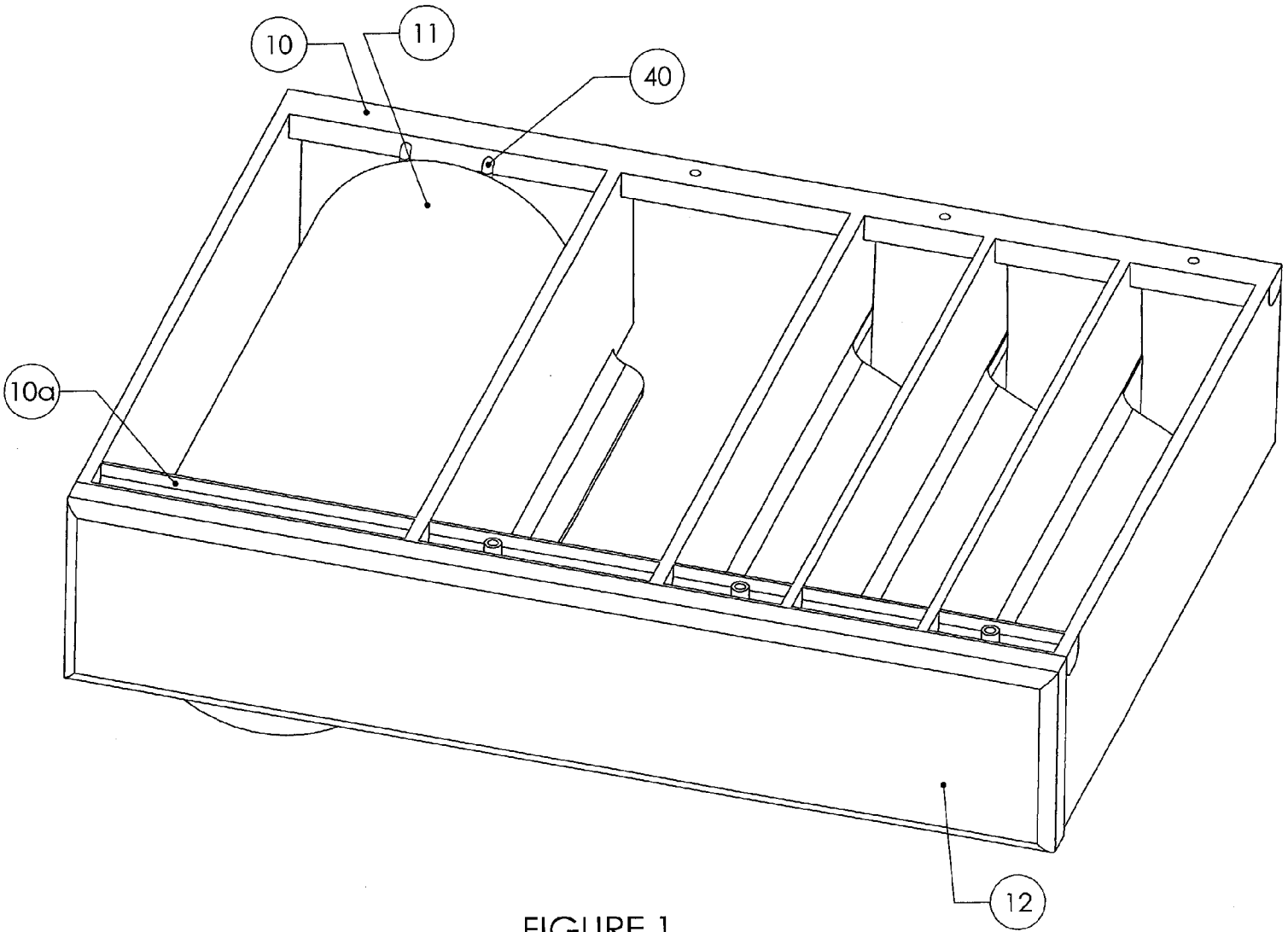
FIG. 1 is a perspective view of a preferred embodiment with the paper towel in a separate compartment and concealed behind the dispenser door.
Figure 1A:
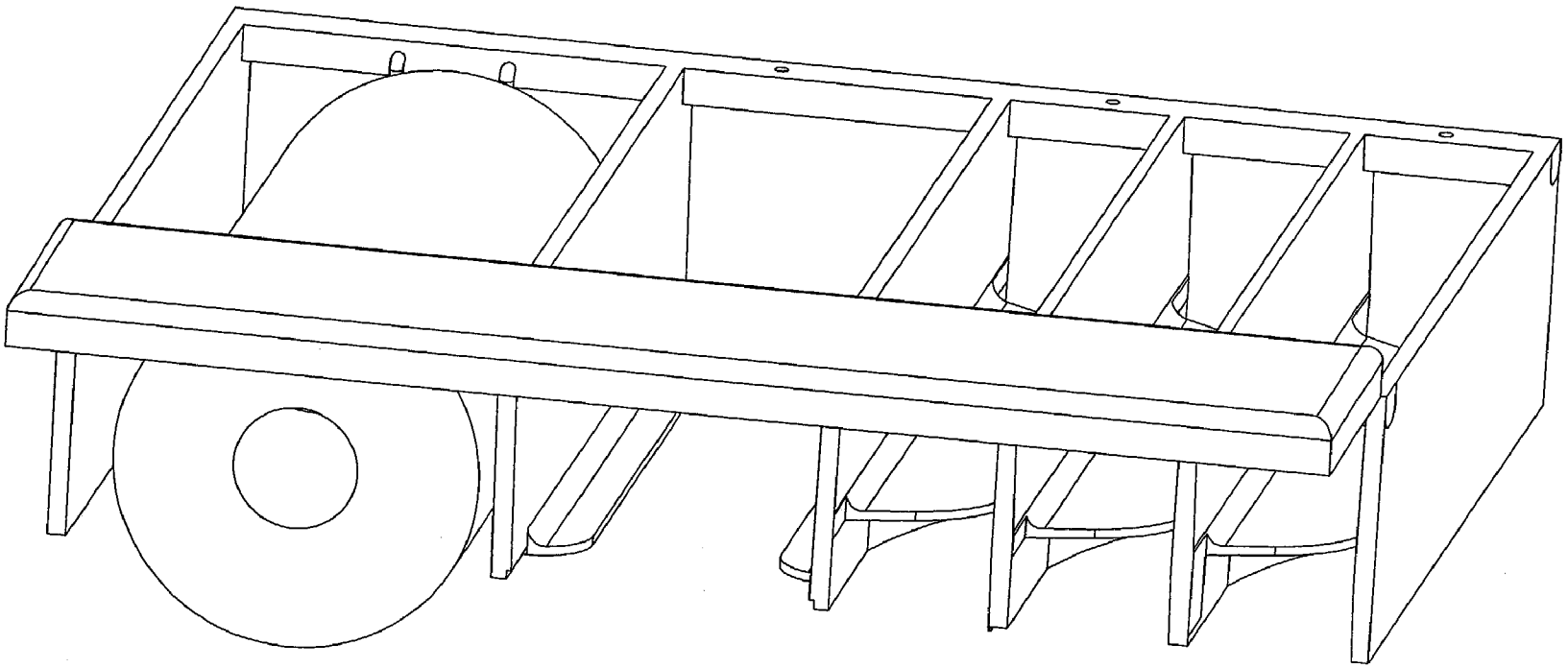
FIG. 1*a* is a perspective view of a preferred embodiment shown with the paper towel in a separate compartment as in FIG. 1, and the door open to allow loading and removal of the rolls, and visual inspection.
Figure 4:
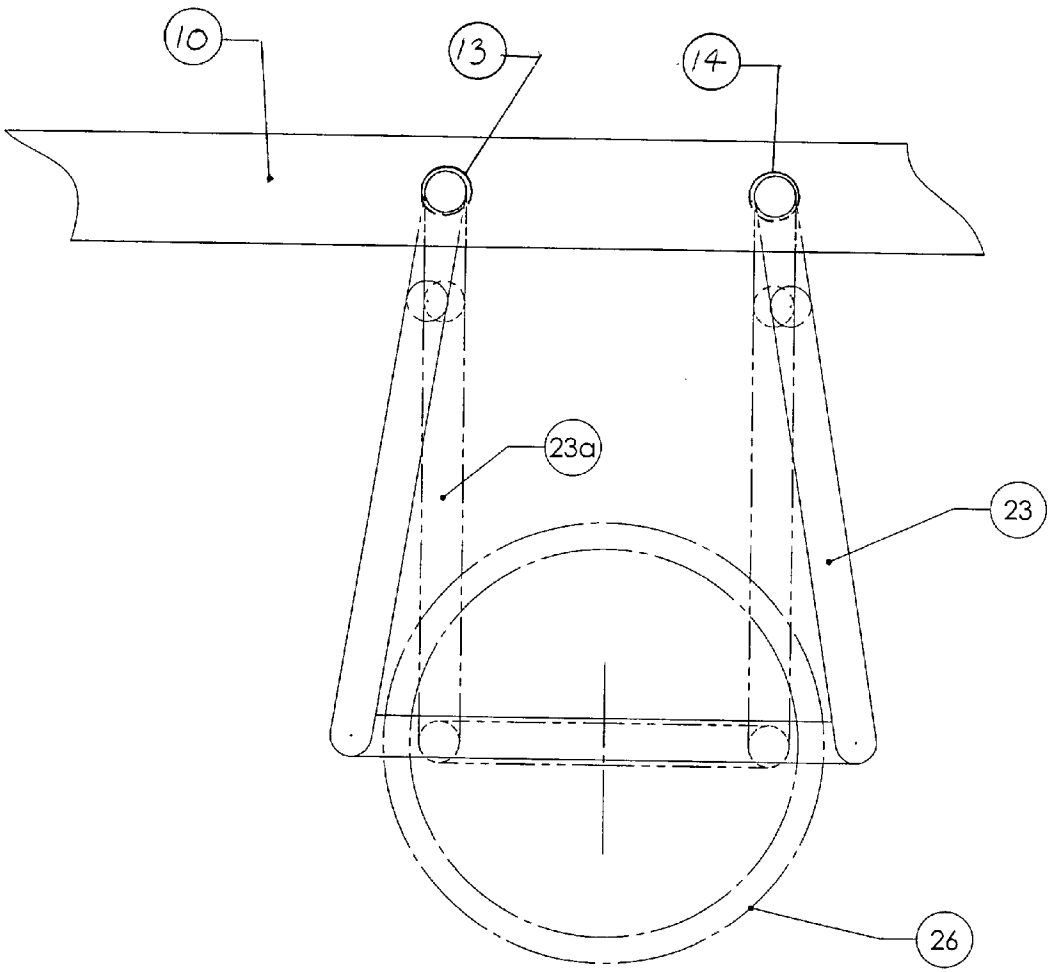
FIG. 4 is a rear view of the removable roll holding means showing the flexible and adjustable tensioning means on a phantom roll core.

According to one aspect of the present invention, as shown in FIG. 1, and FIG. 1*a,* the paper towel roll 11 is located below the two support beams 10 and 10*a*, such that it may be enclosed by the dispenser door 12. A removable and reversible roll holding means 40 is provided for holding the paper towel between two horizontally spaced vertical side panels 19, 19*a*. The holding means 23, as shown in FIG. 4, supportably holds the roll from the inside of the core 26 on which the roll is wound and provides adjustable tensioning forces against the core. In one embodiment of the holding means, a 3/16" diameter steel wire is formed such that one end forms an elongated U or tongue, for receiving core 26, the other ends are inserted into holes 13, 14 provided in beams 10, 10*a* for the purpose of receiving the holding means. By spacing the receiving holes wider than the distance of said ends of the wire, tension forces are created and applied for holding the core. In FIG. 4, tension forces are created by the compression of the wire 23 to 23*a*, whereby the wire 23 represents the holding means before the core 26 has been inserted onto said means, and the wire 23*a* after the core 26 has been inserted. The holding means also comprises two perpendicular bends or changes in elevation and allows additional flexibility for core diameter variations and consumer adjustments. The holding means is readily removable and attachable to either of beams 10 and 10*a* which contain receiving holes 13, 14 allowing the general public to choose and reverse the dispenser tearing action. In this embodiment, the paper towel is easily inserted onto the tongue from the front of the dispenser. The holding means allows the paper towels to be dispensed independently of the door being opened or closed.

Figure 3:
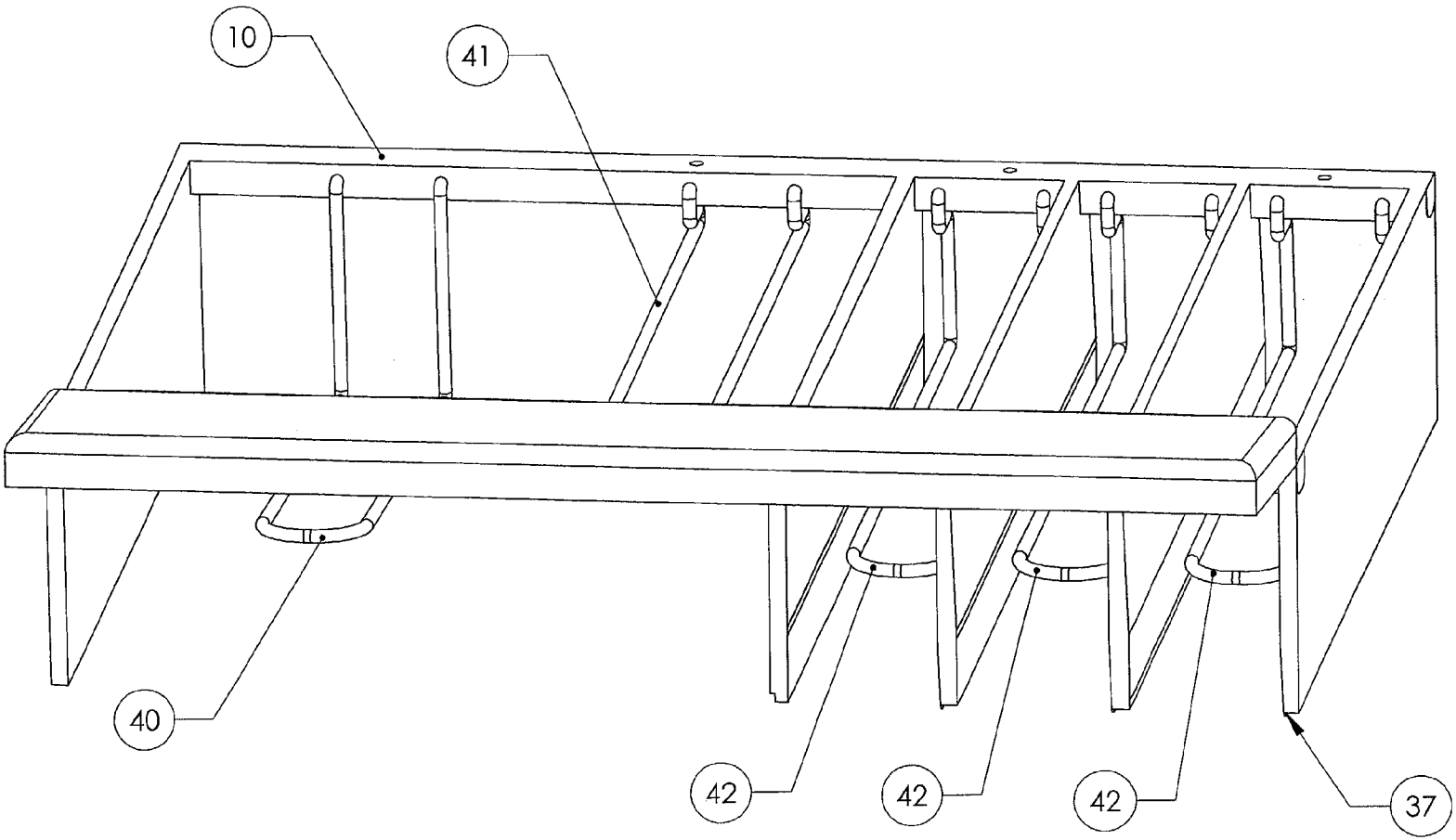
FIG. 3 is a perspective view of an embodiment of the invention shown with removable and reversible roll holding means with adjustable tensioning means, and a removable reversible box holding means.
Figure 3A:
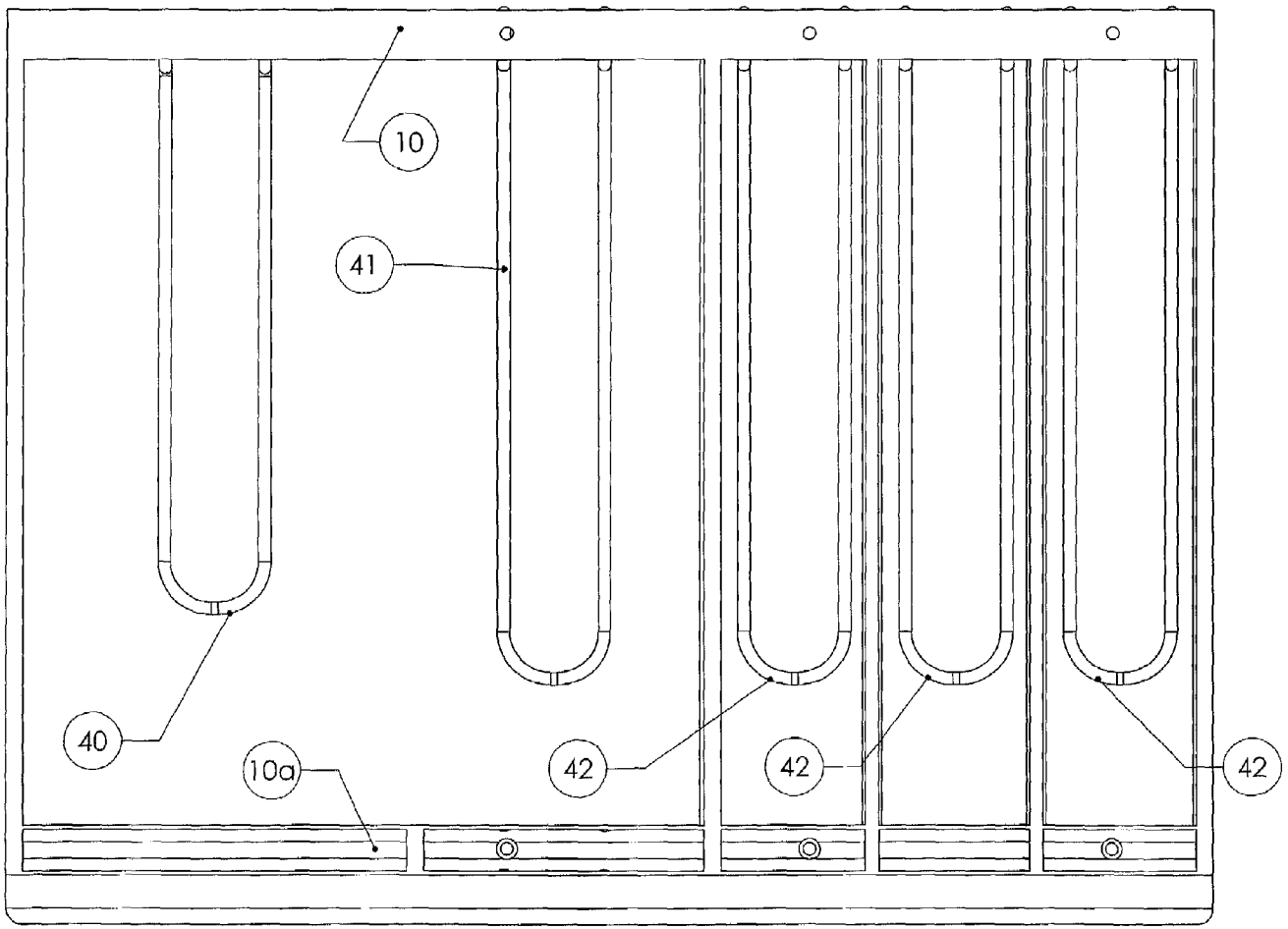
FIG. 3*a* is a top view of FIG. 3 and shown with the door closed.

FIGS. 3 and 3*a* show another embodiment of the invention employing a removable reversible holding means 42 for the smaller rolls of plastic (saran), foil, and wax papers. The roll holding means eliminates the necessity of bottom panels in the prior art, reducing the size and weight of the said panels, and provides additional features as a reversibility and tension control.

Figure 2:
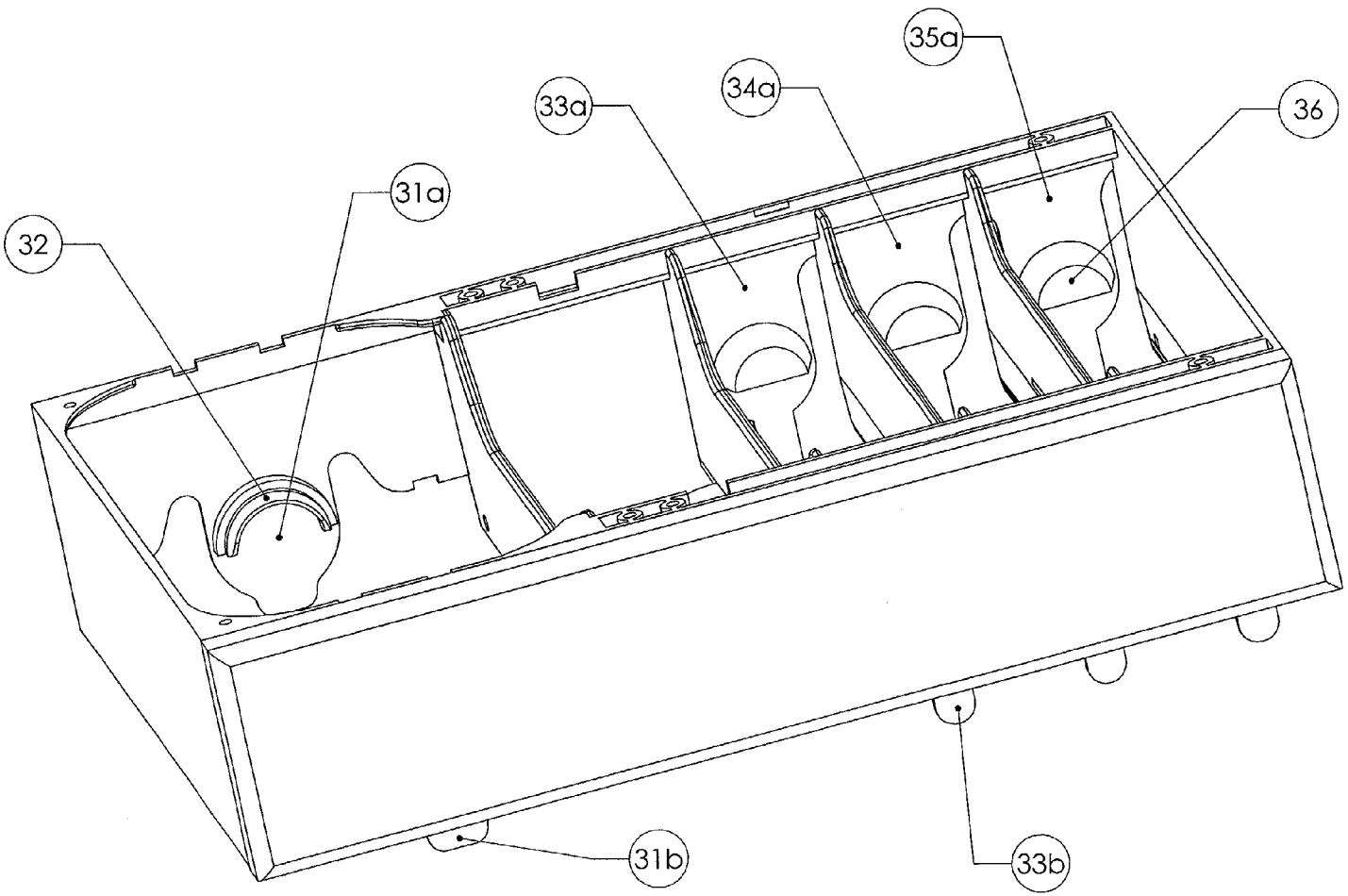
FIG. 2 is a perspective view of another preferred embodiment of the invention shown with thin flexible roll holding means for the rolls of paper, foil, wax, and plastic.
Figure 2A:
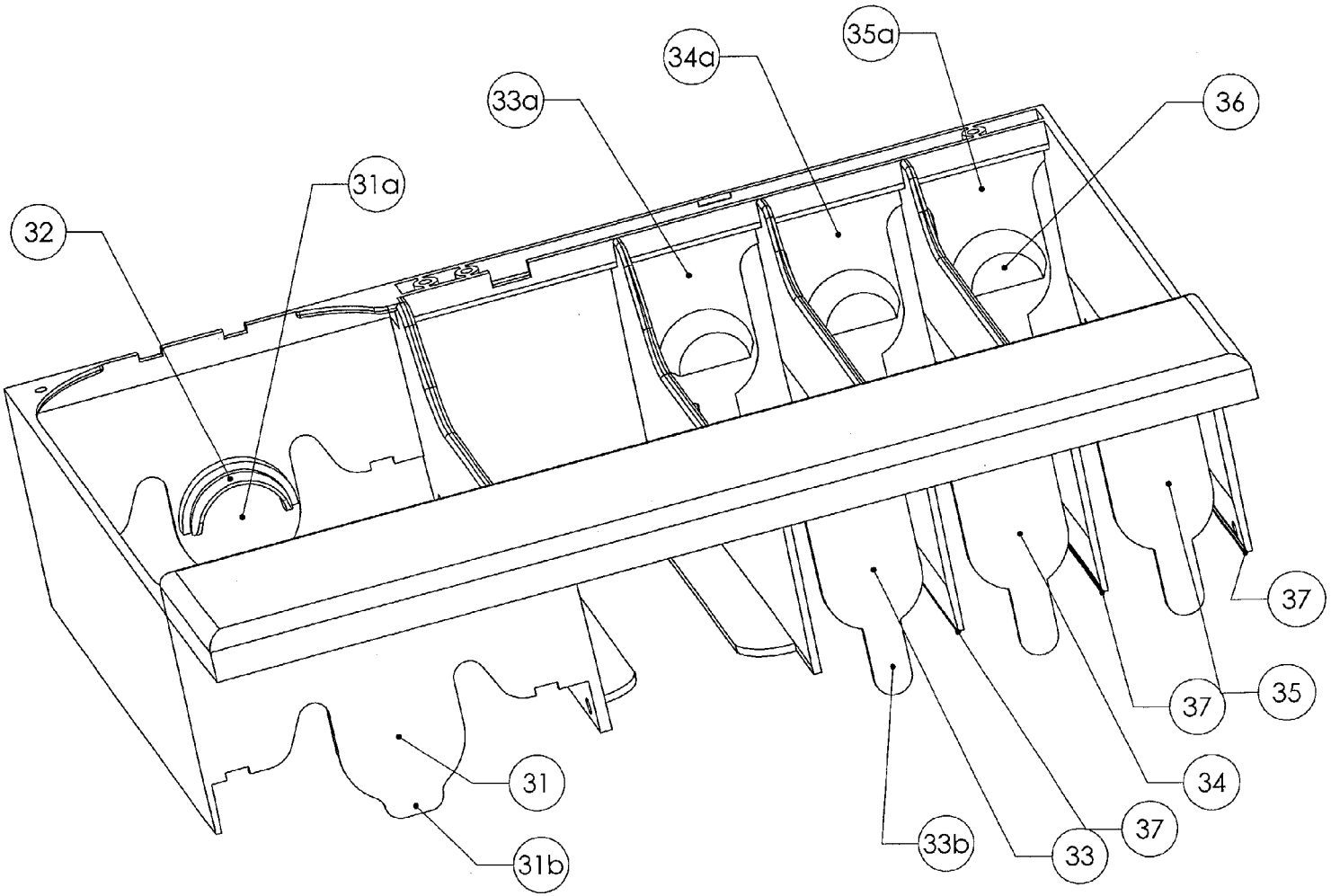
FIG. 2*a* is a perspective view of FIG. 2 shown with the front door open to allow loading and removal of rolls, and visual inspection.

FIGS. 2 and 2*a* show another embodiment of the invention that is suitable and may provide increased advantages for one piece injection molding. In such a case, it is desirable to have a fixed unmovable roll holding means that will still allow reversibility and tension control. Such an embodiment comprises thin, flexible members, supportably attached to said beams and containing tapered apertures for receiving the roll core. Flexible members 31 and 31*a* are provided with a tapered aperture 32 for holding a paper towel roll. Flexible members 33,33*a*, through 35, and 35*a* are provided with a tapered aperture 36, for holding and receiving the rolls of plastic, wax, and foil. The flexible members provide for a small tab 33*b* that extends down below the door to provide a manual means for removing the core when the dispenser door is opened. The tab is also used as a manual brake that holds the roll during tearing operations when the roll is nearly spent or if the flexible members are insufficient to provide tension. Various surface finishes may be applied to the tapered aperture 32 and 36, as known in the art to affect the roll frictional forces.

To further improve said invention, a new and improved box holding means 41 is employed. The box holding means is both reversible and removable and adds further to the commercialization of the dispenser. In the prior art, Miller provided a compartment comprising a vertical side panel and a cantilevered horizontal bottom plate. The new box holding means secures a box 52 of rolled goods 53 for dispensing, by employing an interference and frictional fit between said means and the folds of said box, or between the means and an internal side of the box. While some boxes are folded to allow insertion of a holding means, others may require cutting or slitting an opening to receive said means. This novel means for holding and dispensing boxed goods eliminates the need for a compartment and all the various elements and costs associated with it. The holding means in and by itself provides many new and useful features for the invention, but in combination with the improved roll holding means 40 described above, the multi-roll, multi-box dispenser is truly unique. The invention, as currently employed in commerce, requires two models, yet offers consumers the choice of four variations of the roll-box configurations.

FIGS. 3 and 3*a* show one embodiment of a box holding means 41, attached to the beam 10 of one of the preferred embodiments. The holding means 41 consists of a 3/16" diameter steel wire formed in a loop or elongated U for receiving the "fold" of a standard box of rolled goods, the other two ends of the holder are attached to the receiving holes 3, 4 in beam 10.

Figure 3B:
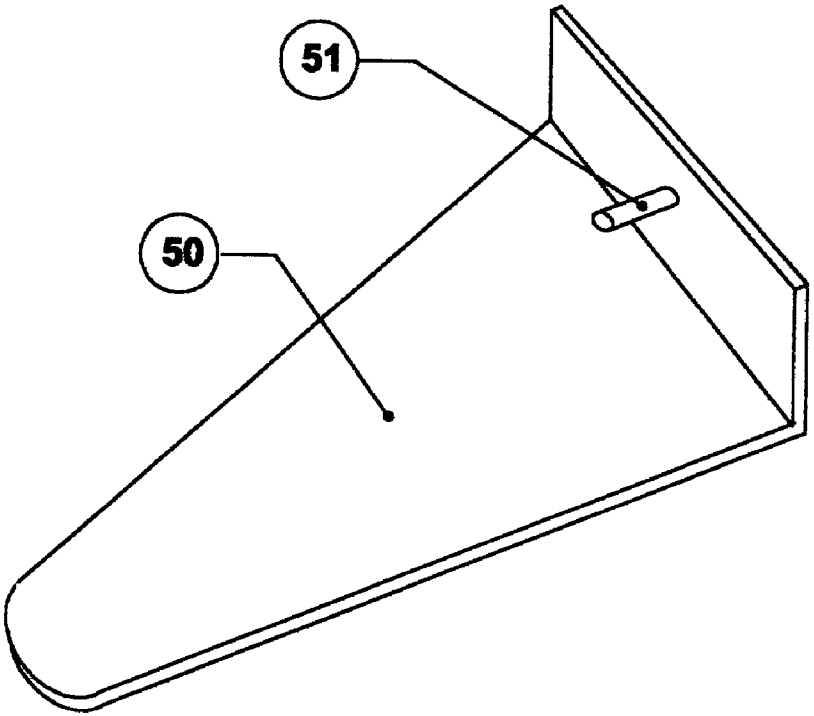
FIG. 3*b* is a perspective of a thin flexible embodiment of a box holding means.
Figure 3C:
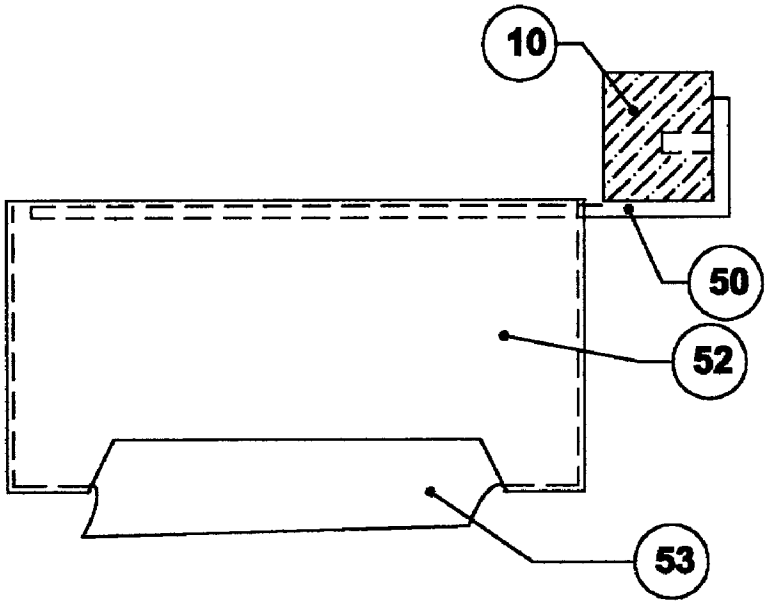
FIG. 3*c* is a side view of the box holding means of FIG. 3*b* holding a box in one of the preferred embodiments.

FIG. 3*b* shows another embodiment of a box holding means 55 comprising, a thin flexible element 50 shaped like a tongue, and having a cylindrical rod 51 for attaching to a support beam 10 of the invention. As shown in FIG. 3C, a box 52 is inserted onto the elongated U portion of the thin flexible element 50 or the wire element 41 between the folds of the cardboard box 52, in such manner as to allow the dispensing of the boxed goods 53 in manner similar to dispensing "Kleenex" tissues. The box holding means securely holds the box in any position such that the goods can be readily dispensed. In combination with the removable roll holding means 40 of said invention, a single large compartment comprising sufficient space to hold a standard roll of paper towels and a single box of goods held in place by the removable box holding means 41, can be easily converted to a compartment for holding three boxed goods. This improvement requires the addition of an extra box holding means and the addition of two receiving holes in said members. The additional versatility and consumer choices versus the extra little cost of the wire type embodiment holding means 41 provides an enormous commercial benefit and advantage over prior art.

Since consumers use a wide variety of boxed goods, the holding means is likely to comprise of several thin flexible strip elements attached commonly to a base or frame. When employing an embodiment of this nature to the present invention, three flexible strip elements may be employed and removably attached to support beams 10 and 10*a*. In combination with the removable reversible paper towel roll holding means 40, a compartment of the invention is capable of holding and dispensing one roll of towels and one boxed good, or by removing the roll holding means, three boxed goods holding means would also be available for the consumer without additional costs. The thin flexible box holding means would lie flat above the paper towel roll if the consumer would rather use the space for paper towels instead of boxed goods. By changing or adding compartments, many other useful combinations of rolls and boxed goods are available.

Figure 5:
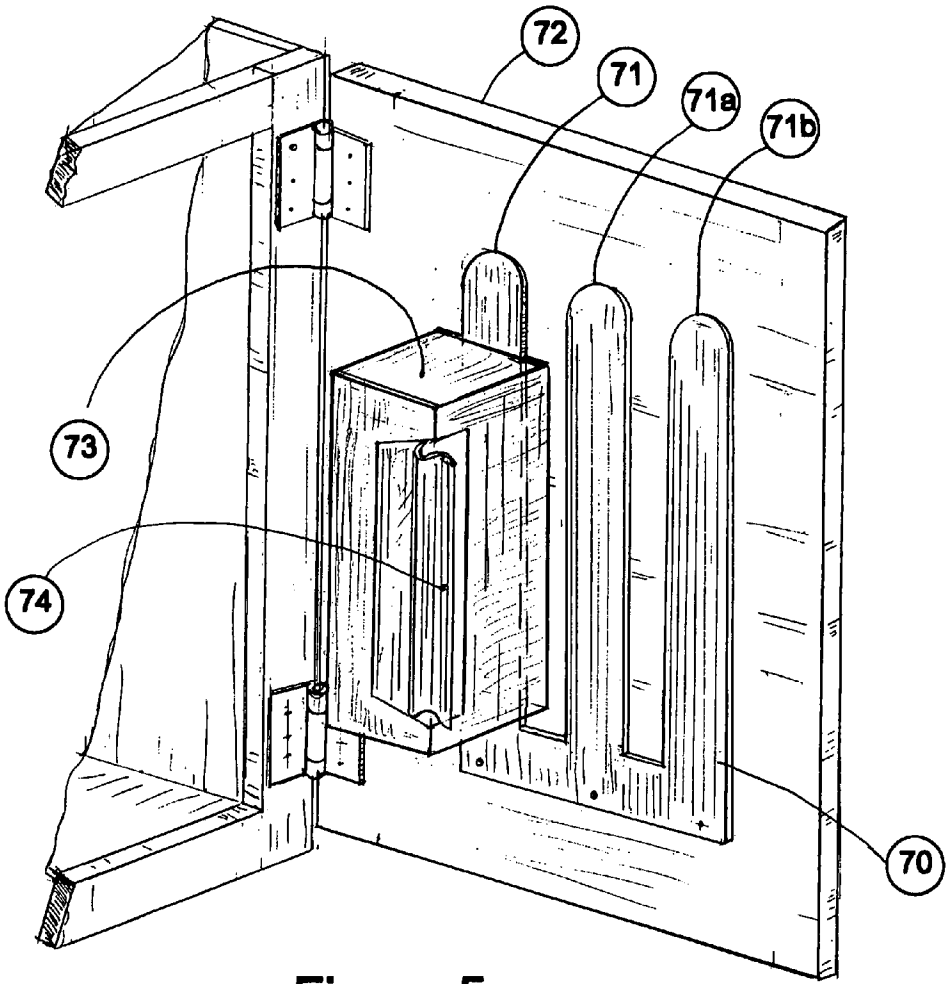
FIG. 5 is a perspective view of a thin flexible box holding means attached to the inside surface of a cabinet door for receiving and holding several boxes.

FIG. 5 shows another embodiment of a box holding means employing three thin flexible elements 71, 71*a*, and 71*b*, commonly joined from a single base 70 and attached to a single vertical surface such as the back side (inside) of a cabinet door 72. A box 73 is supportably held in place against the door 72 by the flexible element 71 which inherently resists the bending forces applied to it when the boxed goods 74 is dispensed from the box 73. In a further embodiment, the holding means could be fastened to the bottom of a standard kitchen drawer. The consumer would only have to pull the drawer out, and the boxed goods would be held securely and neatly in place with the opened end up, conveniently ready to be dispensed. Unlike wire compartments, whereby a variety of boxed goods are stored, the box holding means would not require any appreciable space when not being used to hold a box.

The box holding means should not be considered limited to household boxed goods, but should prove useful for the dispensing of a wide range of materials from their original boxes as used today in commerce. Other household applications include gift wraps, and also other roll products such as foil, plastic, and wax paper. Currently, the rolls packaged in boxes are not provided with an open top or dispensing slots, but the novelty of a new holding means is disclosed herein may provide the stimulus for a new class of boxes and/or dispensing apparatus.

I claim:

1. A sheet material dispenser for locating beneath a cabinet or shelf and unmovably supporting a plurality of rolls of household wraps and boxed goods, having a front door for closure, comprising:

a. an attachment means for securing said dispenser beneath a cabinet comprising a plurality of horizontal support members;

b. compartments for receiving rolls and boxed goods comprising horizontally spaced vertical side panels attached transversely to said horizontal support members, said compartments are substantially aligned in a horizontal plane;

c. a box holding means for holding said box of goods wherein a box of household goods is placed within at least one of said compartments, said box being securely held such that said goods can be dispensed and removed from the underside of the compartment;

d. a roll holding means for holding a roll of paper towels supportably attached to one of said horizontal support members and placed within one of said compartments, whereby said roll of paper towels when placed on said roll holding means is securely held during a dispensing operation such that said paper towels can be dispensed from the underside of said compartment, said roll holding means comprising a rod shaped to form a loop or an elongated U for receiving said roll of paper towels, the two opposite ends of the U shaped rod made for attaching to one of said support members via receiving holes in said support member, and formed to provide a vertical distance below said support members, whereby said roll of paper towel can be inserted onto the elongated U shaped rod;

e. a cutting means for separating a portion of the rolled sheet material comprising a serrated edge supportably attached to the bottom of at least one of said vertical side panels;

f. said front door for removing and replacing said rolls and boxed goods wherein said front door is openly affixed in front of said vertical side panels thereby forming a front end panel for said dispenser.

2. A dispenser of claim 1, wherein one or more of said compartments comprise a bottom panel cantilevered from one of said side panels and extends toward an adjacent side panel, thereby forming a longitudinal dispensing slot.

3. A dispenser of claim 1, wherein box holding means comprises two bottom panels cantilevered from each said side panel of said compartment and extending toward each other whereby a longitudinal dispensing slot is formed.

* * * * *